US011076674B2

(12) United States Patent
Chaillet-Piquand et al.

(10) Patent No.: US 11,076,674 B2
(45) Date of Patent: Aug. 3, 2021

(54) COSMETIC APPLICATOR

(71) Applicant: L'Oreal, Paris (FR)

(72) Inventors: Noémie Chaillet-Piquand, Paris (FR); Maud Jullien, New York, NY (US); Lemis Tarajano, New York, NY (US)

(73) Assignee: L'Oreal, Paris (FR)

( * ) Notice: Subject to any disclaimer, the term of this patent is extended or adjusted under 35 U.S.C. 154(b) by 119 days.

(21) Appl. No.: 15/693,312

(22) Filed: Aug. 31, 2017

(65) Prior Publication Data

US 2019/0059548 A1 Feb. 28, 2019

(51) Int. Cl.

| | |
|---|---|
| ***A45D 33/34*** | (2006.01) |
| ***A45D 34/04*** | (2006.01) |
| ***A45D 40/26*** | (2006.01) |

(52) U.S. Cl.

CPC ..... *A45D 33/34* (2013.01); *A45D 34/04* (2013.01); *A45D 40/26* (2013.01); *A45D 2200/1018* (2013.01); *A45D 2200/1063* (2013.01)

(58) Field of Classification Search

CPC .... A45D 34/041; A45D 34/04; A45D 40/261; A45D 27/02; A45D 27/04; A45D 40/26; A45D 37/00; A45D 33/005; A45D 2200/1009; A45D 2200/1018; A45D 2200/1063; A45D 2200/1036; A45D 33/34; A47K 7/03; A47K 7/02; A47L 13/00; A47L 13/10; A47L 13/17; A47L 13/26

USPC ..... 15/210.1, 209.1, 244.3, 231; 132/320, 132/317, 289

See application file for complete search history.

(56) References Cited

U.S. PATENT DOCUMENTS

| | | | | |
|---|---|---|---|---|
| 1,439,734 A * | 12/1922 | Guinzburg | ..... | A45D 33/34 15/229.14 |
| 2,002,144 A | 5/1935 | Heaton | | |
| 2,511,557 A | 6/1950 | Arnold | | |
| 2,621,784 A | 12/1952 | Van Boytham | | |
| 3,337,895 A * | 8/1967 | Clements | ..... | A45D 33/34 15/229.14 |
| 3,955,233 A | 5/1976 | Nakamura | | |

(Continued)

FOREIGN PATENT DOCUMENTS

| | | |
|---|---|---|
| DE | 28 34 801 A1 | 2/1980 |
| WO | 2017105045 A1 | 6/2017 |

OTHER PUBLICATIONS

International Search Report and Written Opinion dated Dec. 12, 2018, issued in corresponding International Application No. PCT/US2018/048630, filed Aug. 29, 2018, 13 pages.

(Continued)

*Primary Examiner* — Mark Spisich
*Assistant Examiner* — Abbie E Quann
(74) *Attorney, Agent, or Firm* — Christensen O'Connor Johnson Kindness PLLC

(57) ABSTRACT

In one aspect, a cosmetic applicator includes a core having at least one interior compartment that is configured to be pressurized.

In another aspect, a cosmetic applicator includes a first core having at least a first interior compartment that is configured to be pressurized, and a cover removably securable on the first core.

In another aspect, a cover is for a cosmetic applicator having a first core with at least a first interior compartment that is configured to be pressurized.

In another aspect, a cover for a first cosmetic applicator is at least one of removable, washable, and disposable.

17 Claims, 4 Drawing Sheets

(56) References Cited

U.S. PATENT DOCUMENTS

| | | | | |
|---|---|---|---|---|
| 4,670,962 | A * | 6/1987 | Giallourakis | A47L 13/16 15/118 |
| 6,467,981 | B1 * | 10/2002 | Gueret | A45D 40/00 401/201 |
| 6,585,511 | B2 | 7/2003 | Dragan et al. | |
| 9,259,075 | B2 * | 2/2016 | Gordon | A45D 34/04 |
| 9,307,827 | B2 * | 4/2016 | Brewer | A46B 15/001 |
| 9,492,001 | B2 | 11/2016 | Luzon et al. | |
| 9,750,533 | B2 * | 9/2017 | Brewer | A45D 34/041 |
| 10,117,811 | B2 * | 11/2018 | Aubert | A61Q 5/10 |
| 2004/0031723 | A1 | 2/2004 | Jean-Louis | |
| 2004/0258457 | A1 | 12/2004 | Legendre | |
| 2017/0258203 | A1 | 9/2017 | Crane et al. | |
| 2018/0317628 | A1 | 11/2018 | Villarreal et al. | |
| 2018/0344007 | A1 | 12/2018 | Huang | |

OTHER PUBLICATIONS

International Search Report and Written Opinion dated Feb. 14, 2019, issued in corresponding International Application No. PCT/US2018/063128, filed Nov. 29, 2018, 14 pages.

* cited by examiner

COSMETIC APPLICATOR

SUMMARY

In one aspect, a cosmetic applicator includes a core having at least one interior compartment that is configured to be pressurized.

In another aspect, a cosmetic applicator includes a first core having at least a first interior compartment that is configured to be pressurized, and a cover removably securable on the first core.

At least one of the first core and the cover may be comprised at least in part of at least one of a hydrophilic material and a hydrophobic material.

The hydrophilic material may be chosen from a group consisting of polyvinylpyrolidone (PVP), polyurethanes, polyacrylic acid (PAA), polyethylene oxide (PEO), polysaccharides, and any combination thereof.

The hydrophobic material may be chosen from a group consisting of manganese oxide polystyrene (MnO2/PS) nano-composite, zinc oxide polystyrene (ZnO/PS) nano-composite, precipitated calcium carbonate[3], carbon nanotube structures, silica nano-coating, and any combination thereof.

At least one of the first core and the cover may be treated with a plasma treatment.

At least one of the first core and the cover may have a patterned surface to increase wettability.

The cover may include at least a first pocket configured to receive the first core and a second pocket configured to receive a second core, wherein the second core has at least a second interior compartment that is configured to be pressurized.

The first pocket may comprise a first material and the second pocket may comprise a second material.

The first pocket may include a first texture and the second pocket may include a second texture.

The at least one textured surface may be defined by flocking.

An exterior surface of the core may be at least partially flocked.

The cover may include an anti-bacterial treatment.

The cover may be washable.

In another aspect, a cover is for a cosmetic applicator having a first core with at least a first interior compartment that is configured to be pressurized.

The shape and size of the cover may substantially conform to the shape and size of the core.

The cover may further include at least one textured surface.

The cover may further include at least a first area made from a first material and second area made from a second material.

The cover may be comprised at least in part of at least one of a hydrophilic material and a hydrophobic material.

The hydrophilic material may be chosen from a group consisting of polyvinylpyrolidone (PVP), polyurethanes, polyacrylic acid (PAA), polyethylene oxide (PEO), polysaccharides, and any combination thereof.

The hydrophobic material may be chosen from a group consisting of manganese oxide polystyrene (MnO2/PS) nano-composite, zinc oxide polystyrene (ZnO/PS) nano-composite, precipitated calcium carbonate[3], carbon nanotube structures, silica nano-coating, and any combination thereof.

The cover may be treated with a plasma treatment.

The cover may include a patterned surface to increase wettability.

The cover may include at least a first pocket configured to receive the first core and a second pocket configured to receive a second core, the second core having at least a second interior compartment that is configured to be pressurized.

The first pocket may include a first material and the second pocket may include a second material.

The first pocket may include a first texture and the second pocket may include a second texture.

The at least one textured surface may be defined by flocking.

The cover may include an anti-bacterial treatment.

The cover may be washable.

In another aspect, a cover for a first cosmetic applicator is at least one of removable, washable, and disposable.

The shape and size of the cover may substantially conform to the shape and size of the cosmetic applicator.

The cover may further include at least one textured surface.

The cover may further include at least a first area made from a first material and second area made from a second material.

The cover may be comprised at least in part of at least one of a hydrophilic material and a hydrophobic material.

The hydrophilic material may be chosen from a group consisting of polyvinylpyrolidone (PVP), polyurethanes, polyacrylic acid (PAA), polyethylene oxide (PEO), polysaccharides, and any combination thereof.

The hydrophobic material may be chosen from a group consisting of manganese oxide polystyrene (MnO2/PS) nano-composite, zinc oxide polystyrene (ZnO/PS) nano-composite, precipitated calcium carbonate[3], carbon nanotube structures, silica nano-coating, and any combination thereof.

The cover may be treated with a plasma treatment.

The cover may include a patterned surface to increase wettability.

The cover may include at least a first pocket configured to receive the first cosmetic applicator and a second pocket configured to receive a second cosmetic applicator.

The first pocket may include a first material and the second pocket may include a second material.

The first pocket may include a first texture and the second pocket may include a second texture.

The at least one textured surface may be defined by flocking.

The cover may include an anti-bacterial treatment.

The cover may be washable.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Cosmetic formulations are often applied to a person's face, hair, skin, nails, etc., with an applicator, such as a brush, sponge, bristle, cloth, etc. The configuration will depend on the intended end use. For instance, cosmetic formulas applied to (or removed from) the skin, such as the face, may be applied or removed with a sponge, cloth, puff, etc. The sponge, cloth, puff, etc., is not typically shaped to appropriately apply formulation to every contour of the face or another area of the body. For instance, a sponge may be an overall oval shape with flat sides. Although such a shape may be appropriate for applying a formulation to large areas of the face, the rounded edges may not be small enough to reach into more contoured areas of the face, such as under the eyes or nose.

A sponge, cloth, puff, etc., may also have a fixed density, firmness, etc., that is suitable for one area of the face, but not another area. For instance, a denser, firmer sponge may be used to apply cosmetic formulation to all areas of the face except the eye area, which requires a softer, more delicate application. Multiple different applicators must be used to apply cosmetic formulations to different areas of the face or similar areas of the body.

Thus, an improved applicator that can be adapted for use on various parts of a user's face, body, hair, nails, etc., for accurate application, removal, and/or cleansing of a cosmetic formulation is desired. Such an improved applicator would beneficially be easy to clean or otherwise hygienic to use.

Figure 1:
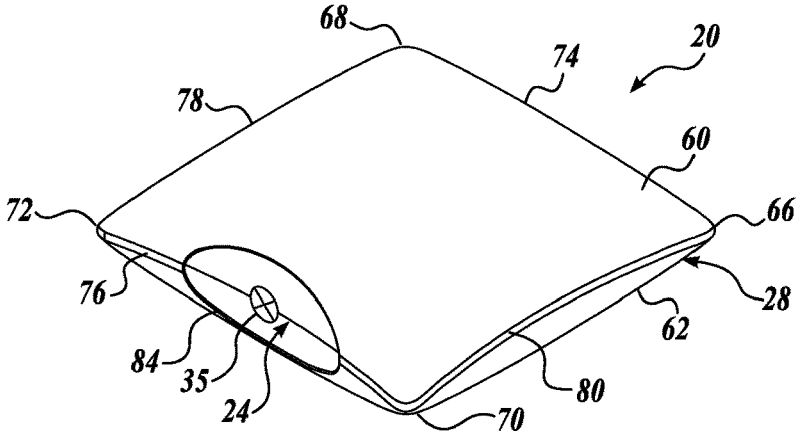
FIG. 1 is an isometric view of a cosmetic applicator formed in accordance with an exemplary embodiment of the present disclosure.
Figure 2:
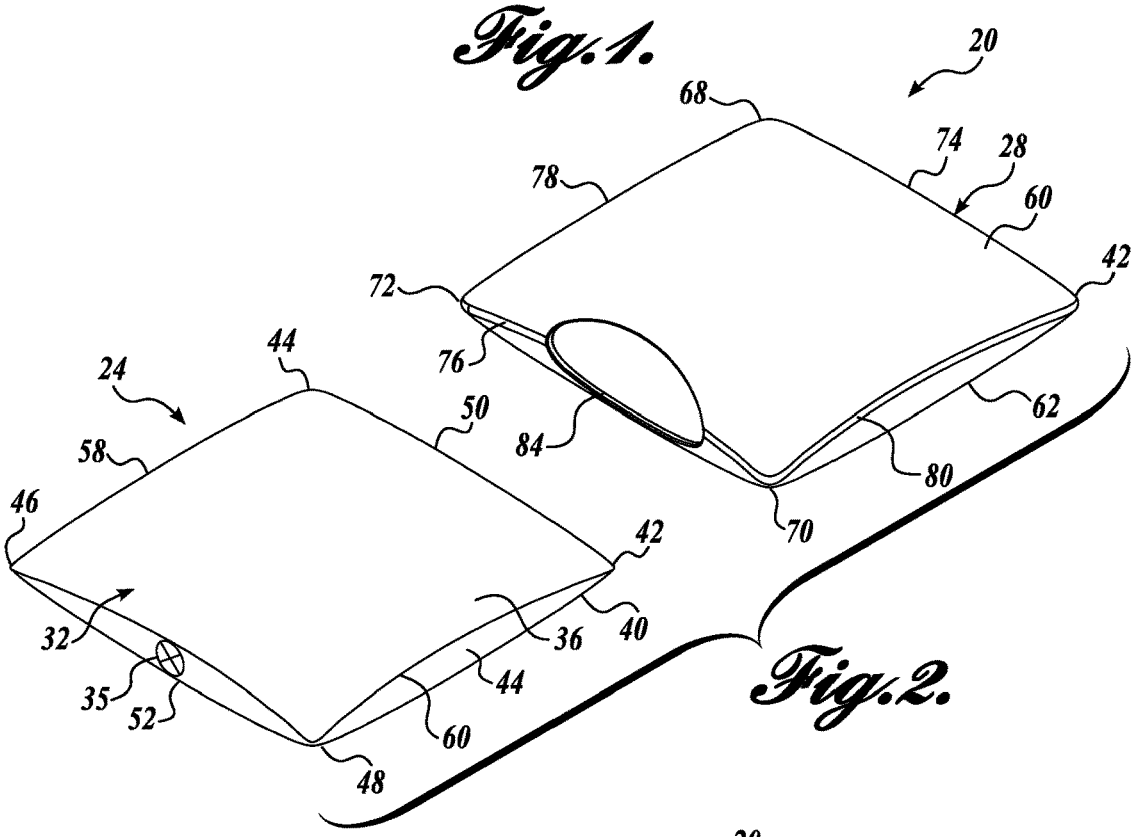
FIG. 2 is an exploded view of the cosmetic applicator of FIG. 1.
Figure 3:
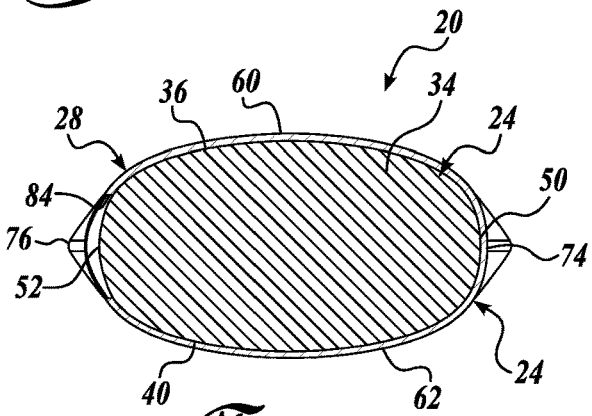
FIG. 3 is a cross-sectional view of the cosmetic applicator of FIG. 1.

Referring to FIGS. 1-3, a first exemplary embodiment of a cosmetic applicator 20 will now be described in detail. The cosmetic applicator 20 is of a suitable shape, size, firmness, material, etc., for precisely and hygienically applying and/or removing a cosmetic formulation from a desired area of a user, such as the face, skin, nails, hair, etc. In that regard, in one embodiment, the cosmetic applicator 20 includes a sealed, pressurizeable core 24 optionally enveloped or enclosed by a removable, washable, and/or disposable cover 28.

The pressurizeable core 24 will first be described in detail. The pressurizeable core 24 has a body 32 made from a suitably deformable and/or expandable material that defines at least one interior compartment 34 that can be inflated or deflated as desired, like a bag, pillow, or cushion. For instance, the body 32 may be made from a material such as plastic (such as a suitable polymer), rubber, fabric, etc., such that when air or another gas, fluid, liquid, semi-solid, or solid is injected into the interior compartment 34 of the body 32, the volume of the interior compartment 34 is increased or decreased as needed to adjust the firmness, size, shape, etc., of the pressurizeable core 24. In that regard, the body 32 may include a suitable opening and/or valve 35 for inflating and deflating or otherwise filling/emptying the body 32.

The vacuum contained within the in the interior compartment 34 allows a precisely controlled deformation of the pressurizeable core 24 to fit to the relief and the hollows of the continuous surface of the skin or other surface. For instance, the adjusted and appropriate pressure allows the pressurizeable core 24 (sides, edges, corners, etc.) to fit to any face anatomy or desired area of the body. In one embodiment, the pressure is in between about 15-30 psi. By having the ability to add or remove air, gas, liquid, semi-solid, solid, etc., from the interior compartment 34 (with the valve 35, for instance), the user may adjust the interior pressure of the core 24 according to his/her needs and therefore have, with only one applicator, several functions depending on the pressure that is chosen/selected.

The body 32 may be at least partially filled with any suitable material (gas, liquid, semi-solid, solid, etc.) for providing an applicator 20 of a desired firmness, resiliency, malleability, sensorial effect, etc., for the intended application. For instance, in some embodiments, the body 32 may be filled with a gas, such as ambient air, to provide a light-weight, resilient applicator 20. In other embodiments, the body 32 may be filled with a liquid, such as water, to provide a heavier applicator 20. In yet other embodiments, the body 32 may be filled with a denser material, such as oil, to make the applicator more firm such that it is more precise for contouring products, concealers, or other products that require precision. In yet other embodiments, the body 32 may be filled with foam or a similar material to provide a semi-dense, lightweight, malleable applicator 20. It should be appreciated that the material used to at least partially fill the body 32 may be adjusted in viscosity and other physical and chemical properties to adjust the firmness, resiliency, malleability, sensorial effect, etc., for the intended application. Moreover, in alternate embodiments, the body 32 may have multiple interior compartments, with each configured to be filled with a different material and/or with a different pressure. In such alternative embodiments, the applicator 20 would include areas of varying firmness, resiliency, malleability, sensorial effect, etc., for various applications with a single applicator.

As noted above, the body 32 may be made from a suitably deformable and inflatable material such as plastic (such as a suitable polymer), rubber, fabric, etc. The material may be any suitable thickness (such as between about 0.1 mm and 2 mm) in one or more areas of the body 32 to provide a more firm (with a thicker material) or less firm (with a thinner material) core 24. As a specific example, the material may be thinner in the larger areas of the body 32 and thicker in the smaller areas of the body, such as in corners or more pointed areas. As yet another example, a first side of the body 32 may have a first thickness and an opposite side of the body 32 may have a second thickness.

The material of the body 32 may be either transparent, translucent, opaque, foiled or metallized, patterned, etc., in whole or part, and/or coated at least partially with a transparent, translucent, or opaque material or film. For instance, in some embodiments, the body 32 will be transparent such that when the interior compartment 34 is filled, it can be easily seen by the user. In other embodiments, the body 32 is a certain translucent or transparent material having a designated color for corresponding to an intended application. In other embodiments, certain portions of the body 32, such as the corners, are of a certain translucency and/or color to indicate a target area for application. The pressurizeable core 24 may also be made from and/or coated with a suitably waterproof material such that it may be easily cleaned and reused for various applications and such that cosmetic formulation transfer may be substantially prevented.

Figure 8:
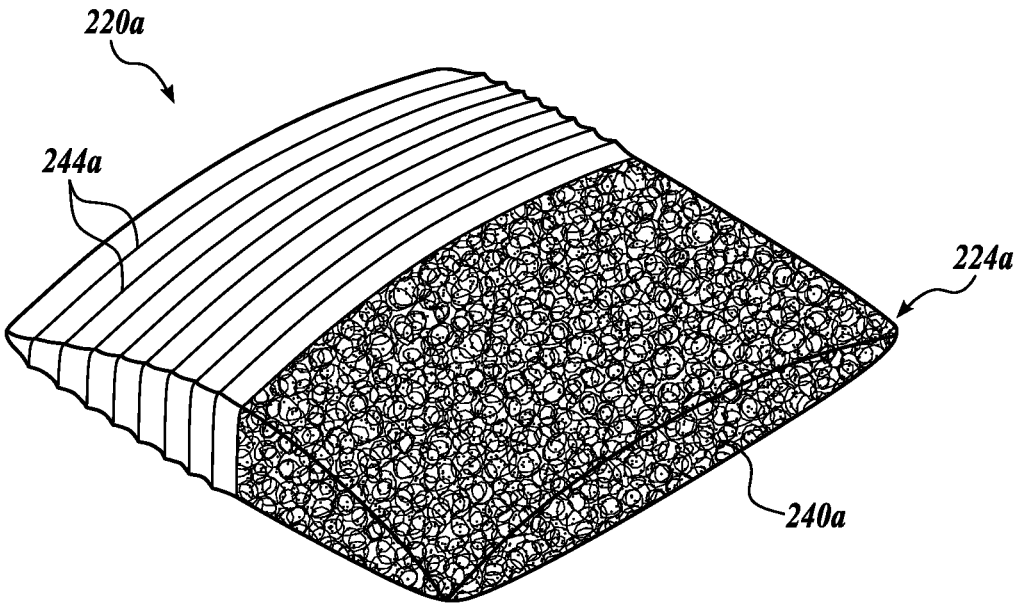
FIG. 8 is a cross-sectional view of a cosmetic applicator formed in accordance with another alternative exemplary embodiment of the present disclosure.

The material or outer surface of the body 32 may also vary in surface roughness/texture, shape, coefficient of friction, etc., in different areas of the body. For instance, in an alternative embodiment of a core 220*a* shown in FIG. 8, the core 224*a* includes a first outer surface area having flocked material 240*a*, and a second outer surface area having ridges 244*a*. A lower coefficient of friction on the outer surface of the body 32 may provide a non-sticky surface for a smoother application of certain cosmetic formulations (such as lip gloss), wherein a textured surface may be more suitable for cleansing or application of other types of cosmetic formulations. For instance, the flocked area 240*a* shown in FIG. 8 may be used to substantially evenly apply powder or viscous foundations to a user's face or other skin. Moreover, in the alternative embodiment discussed above with a body having multiple interior compartments, the outer surface of the body may have different areas of varying texture, coefficient of friction, etc., to correspond to a uniquely pressurized interior compartment. For instance, a softer interior compartment may include a more textured surface to provide suitable abrasion of a surface, whereas a firmer core 24 may have a smoother surface for a non-abrasive application. It should be appreciated that any suitable combination of features or configurations may be used.

The body 32 is also suitably shaped for the intended application. For instance, the body 32 may be suitable shaped for application/removal of a cosmetic application to a large surface area, such as the cheeks and forehead of the face, as well as a more targeted area, such as under the eyes, nose, and the chin of the face. In the exemplary embodiment depicted in FIGS. 1-3, the body 32 is substantially square or rectangular, having first and second opposing sides 36 and 40 and first, second, third, and fourth corners 42, 44, 46, and 48. The first and second sides 36 and 40 are sealed along their upper and lower edges 50 and 52 and first and second side edges 58 and 60 to define an overall pillow shaped core 24 having soft edges.

The corners 42, 44, 46, and 48 and edges 50, 52, 58, and 60 of the pillow-shaped core 24 are therefore suitable for applying/removing a cosmetic formulation to/from a more contoured or narrow area, such as around the eyes, nose, chin, etc. At the same time, the first and second opposing sides 36 and 40 define a larger application area for application/removal of a cosmetic formulation to a larger surface area, such as the cheeks and forehead of the face. In other embodiments, the body may include specially shaped portions for targeted application, such as cone-shaped areas, pointed areas, etc. Thus, it can be appreciated that the contoured shape of the body 32 can precisely fit within the edges, contours, hollows, etc., of a user's body with suitable relief to allow gentle and precise application or removal of a cosmetic formulation onto or from the skin, hair, scalp, nails, etc. A suitable handle, tab, etc. (not shown), solid or flexible, may extend from the body 32 for gripping and using the core 24 during application. The body 32 could also be configured to be attached to one or more different types of handles depending on the end use.

The optional removable, washable, and/or disposable cover 28 for receiving and covering the pressurizeable core 24 will now be described in detail. The cover 28 may be used for application or removal of certain cosmetic formulations that cannot otherwise be applied or removed with the core 24, and/or to provide a different sensorial experience during application than would happen with the core alone. It should be appreciated that the core 24 may be used with or without the cover 28.

In the depicted embodiment, the cover 28 is configured to envelope or enclose the pressurizeable core 24 in a manner such that the cover 28 substantially and tightly conforms to the shape of the core 24 to precisely fit (together with the core 24) within the edges, contours, hollows, etc., of a user's body with suitable relief to allow gentle and precise application or removal of a cosmetic formulation. In that regard, the cover 28 is substantially square or rectangular, having first and second opposing sides 60 and 62 and first, second, third, and fourth corners 66, 68, 70, and 72. The first and second sides 60 and 62 are sealed along their upper and lower edges 74 and 76 and first and second side edges 78 and 80 to define an overall pillow shaped cosmetic applicator 20 (when received on the core 24) having soft edges. With the cover 28 substantially conforming to the shape of the core 24, the cosmetic applicator 20 will allow the user to adjust the expected make-up result and the coverage level.

In addition to or in lieu of a tightly conforming fit, the interior surface of the cover 28 may be temporarily or permanently glued to or otherwise attached to the outer surface of the core 24 to minimize any shifting, bunching, or movement of the cover 28 relative to the core 24 during use. In that regard, the outer surface of the core 24 and/or the interior surface of the cover 28 may include one or more adhesive portions that are initially covered by a releasable backing that may be removed prior to use. In an alternative embodiment, the outer surface of the core 24 and/or the interior surface of the cover 28 may be coated with a tacky or other high-friction material to minimize movement of the cover 28 relative to the core 24.

The cover 28 further includes an opening through which the core 24 may be inserted for disposing the cover 28 on the core 24 (and through which any handle, tab, etc., extending from the body 32 may protrude). Any suitable opening may be used, such as an elastic opening 84 defined along a portion of the lower edge 76 that may be stretched over the core 24. In the alternative, the opening 84 may be defined by a non-elastic opening that is enclosable by a hook and loop fastener (Velcro®), a zipper, or another suitable enclosure mechanism. The opening allows the cover 28 to be removable from the core 24 and replaceable with a clean or different cover. In this manner, various different covers 24 may be used with a single pressurizeable core 24. In other words, the cover may be changed depending on the intended application or desired sensorial effect. For instance, the customizable cover will allow for the applicator to be used for skin and/or hair cosmetic formulation application and/or removal.

In that regard, the cover 28 may be made from any suitable material having a suitable porosity, density, durometer, firmness, thickness, etc., for the desired application and aesthetic effect. For instance, the cover 28 may be between about 1 mm to 6 mm thick. Moreover, the cover 28 may vary in thickness in different areas of the cover. For instance, the corners may be thicker than the sides or edges of the cover 28.

With regard to material, in some exemplary embodiments, the cover 28 may be made from a sponge material, a foam (an open or closed cell foam, a flocked foam, etc.), a suitable fabric (e.g., fiber or microfiber material), etc., that is configured for depositing or removing a cosmetic formulation to a user's face, skin, hair, etc. For make-up application, the cover 28 may be configured to deposit a continuous film of a pigmentary solution (powder or liquid) onto the skin to obtain a substantially even coverage. An open cell foam material (PU, PE, etc.) may be used when some absorption of the cosmetic formulation on the cover 28 is desired for an even application, for thicker foundations, etc. A closed cell foam material (such as NBR) may be used to prevent absorption of the cosmetic formulations by the cover 28 and to substantially keep the core 24 from getting dirty or covered with cosmetic formulation. If a flocked material is used, a flocked material having a longer length may be used for applying a low viscous material, wherein a flocked material having a shorter length may be used for applying a high viscous material.

Figure 9:
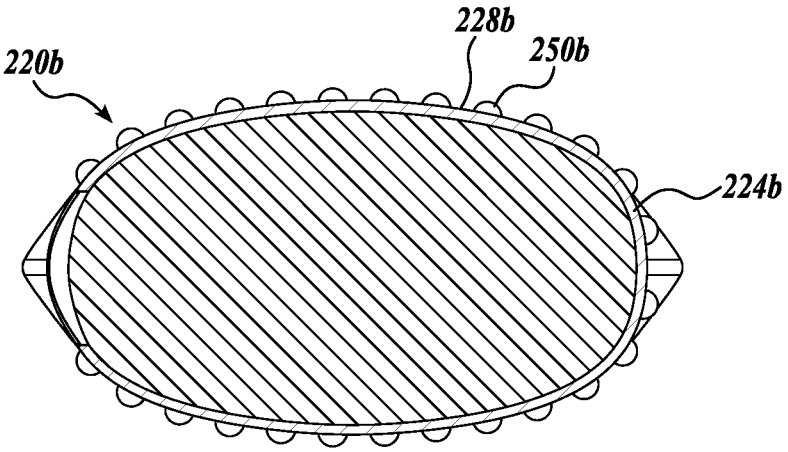
FIG. 9 is an isometric view of a cosmetic applicator formed in accordance with another alternative exemplary embodiment of the present disclosure.

One or more surfaces or areas of the cover 28 (and optionally the core 24) may also include patterned areas, grooves, surface bumps, protrusions, textures, areas of changing color, etc., to aid in the application or removal of a cosmetic formulation, to indicate an intended area of use for a specific application, and/or to provide an aesthetically pleasing cover. For instance, in the exemplary embodiment of a cosmetic applicator 220*b* shown in FIG. 9, the cover 228*b*, which encloses a core 224*b*, includes bumps 250*b* on the outer surface of the cover 228*b*. In other applications, only a portion of the outer surface of the cover 228*b* includes bumps or other texture, with the remaining portions including no texture or different texture. The texture may be created by cutting or defining a pattern in the cover material, by changing the type of material, with flocking, coating, molding, etc.

In other embodiments, the cover 28 may be made from cotton or another soft or absorbent material that aids in removing dirt, makeup, or other debris from the skin or other surface. For make-up removal, the cover 28 may be used with the appropriate make-up remover formula to allow for a gentle removal of the cosmetic formulation previously applied (liquid or powder types). In such a configuration, the cosmetic formulation is removed gently, without clogging any pores, leaving the skin and the face very clean without substantial irritation.

In other embodiments, the cover 28 and/or the core 24 may be laminated with a suitable foam or other material. For instance, the cover 28 and/or the core 24 may be laminated with a composite material known by the name of PolyDry™, available from Creative Foam Medical Systems of Bremen, Ind. As a specific example, the composite material may be applied by thermopressure welding.

The cover 28 (and optionally the core 24) may also be made from or treated with a suitable material that increases wetting of an aqueous phase of any cosmetic formulation on the surface of the cover 28 (and optionally the core 24). In one embodiment, one or more portions of the cover 28 (and optionally the core 24) may be comprised of at least one hydrophilic or a superhydrophilic material.

The wettability of a region can be determined using various technologies and methodologies including contact angle methods, the Goniometer method, the Whilemy method, or the Sessile drop technique. Wetting is a process by which a liquid interacts with a solid. Wettability (the degree of wetting) is determined by a force balance between adhesive and cohesive force and is often characterized by a contact angle. The contact angle is the angle made by the intersection of the liquid/solid interface and the liquid/air interface. Alternatively, it is the angle between a solid sample's surface and the tangent of a droplet's ovate shape at the edge of the droplet. Contact angle measurements provide a measure of interfacial energies and conveys direct information regarding how hydrophilic or hydrophobic a surface is. For example, superhydrophilic surfaces have contact angles less than about 5°, hydrophilic surfaces have contact angles less than about 90°, hydrophobic surfaces have contact angles greater than about 90°, and superhydrophobic surfaces have contact angles greater than about 150°. (see, e.g., U.S. Publication No. 2013/0131575, entitled "Systems, Devices, and Methods Including Infection-Fighting and Monitoring Shunts," the disclosure of which is hereby incorporated by reference herein in its entirety).

As a specific example, the cover 28 (and optionally the core 24) may be treated with one or more hydrophilic coatings, including polyvinylpyrolidone (PVP), polyurethanes, polyacrylic acid (PAA), polyethylene oxide (PEO), and/or polysaccharides. In the alternative or in addition thereto, the cover 28 (and optionally the core 24) may be treated to increase the surface energy of the cover 28 (and optionally the core 24), such as with a plasma treatment.

In another example, the cover 28 (and optionally the core 24) may be comprised of or otherwise treated with one or more hydrophobic or superhydrophobic coatings such as manganese oxide polystyrene (MnO2/PS) nano-composite, zinc oxide polystyrene (ZnO/PS) nano-composite, precipitated calcium carbonate[3], carbon nano-tube structures, and/or silica nano-coating.

Additional non-limiting examples of materials that affect wettability of a surface include, but are not limited to, amphoteric surfactants, anionic surfactants, cationic surfactants, non-ionic surfactants, and the like.

In the alternative or in addition thereto, the cover 28 (and optionally the core 24) may comprise one or more nanostructures, microstructures, hierarchical structures, and the like that affect wettability of a surface. Non-limiting examples of nanostructures, microstructures, hierarchical structures, and the like include nanopatterned, micropatterned, and the like polymeric coatings. Specific examples include patterned silicon surface, perfluorodecyltriethyoxysilane (PFDTES) coatings, poly (methyl methacrylate) (PMMA) patterned structures, polystyrene (PS) (hydrophobic) patterned structures, and the like.

The above-noted treatments may be applied to any suitable portion of the cover 28 (and optionally the core 24). The cover 28 (and optionally the core 24) may also have one or more portions made from and/or coated with a first type of material and one or more portions made from and/or coated with a second type of material. For instance, the first side 60 of the cover 28 may have a first material/coating and the second side 62 of the cover 28 may have a second material/coating. In addition or in the alternative thereto, the first, second, third, and fourth corners 66, 68, 70, and 72 of the cover 28 may be covered with a different material/coating for precise application/removal of a cosmetic application to/from a target area. In one embodiment, the interior of the sides and the corners of the cover 28 can be waterproof treated to substantially avoid any transfer of the cosmetic formulation onto the core 24.

It should also be appreciated that the surface properties of the cover 28 (and optionally the core 24) may be defined in any suitable manner. For instance, the cover 28 (and optionally the core 24) itself may be made from a hydrophilic material or hydrophobic material. In the alternative, the cover 28 (and optionally the core 24) may be made from any suitable material, and one or more surfaces of the cover 28

(and optionally the core 24) may be treated with a hydrophilic material or hydrophobic material. Moreover, the cover 28 (and optionally the core 24) may be treated, coated, sprayed, etc., with a suitable material in any suitable manner. In addition, the cover 28 (and optionally the core 24) may be textured or patterned with a coating in a suitable manner.

The cover 28 may have a suitable amount of elastic such that the cover 28 may be stretched over and secured on the core 24 after the core 24 is passed through the opening 84. In the alternative, the cover 28 may be made from a non-elastic material, with the core 24 being passed through the opening 84 in the cover 28 after it is at least partially deflated. Moreover, the cover 28 may be made from a disposable material, such as cotton, paper, etc., or from a more durable and washable material. In either event, the cover 28 may be removable, washable, and/or replaceable to ensure continued hygienic use of the cosmetic applicator 20, in contrast to classic sponges, brushes and blender make-up applicators that cannot be washed or partially replaced. The cover 28 may also be treated with an antibacterial solution to ensure hygiene with usage.

It can be appreciated from the foregoing that a removable, replaceable, and/or disposable cover 28 allows for the cosmetic applicator 20 to be used for various different needs and effects, such as different make-up looks (e.g., from matte to glow, from subtle to full coverage, etc.) and different functions (e.g., make-up application, make-up or nail polish removal, skin cleansing, hair/scalp applicator, etc.). For make-up use, the user will be able to use one pressurizeable core 24 customized with different covers to apply different cosmetic formulations for different make-up results.

With the above-described features in mind, the cosmetic applicator 20 can be configured to deposit/transfer a cosmetic formulation onto the surface of the skin and leave a continuous film that merges/fits beautifully with the skin for a second-skin effect. Moreover, the cosmetic applicator 20 can be configured to remove a cosmetic formulation film, and substantially only the film, without damaging the skin surface or any sensitive areas. With the user having a choice of pressurizeable core 24 and/or the cover 28, the cosmetic application 20 can produce individual and satisfying sensorial and aesthetic results for the user.

Figure 4:
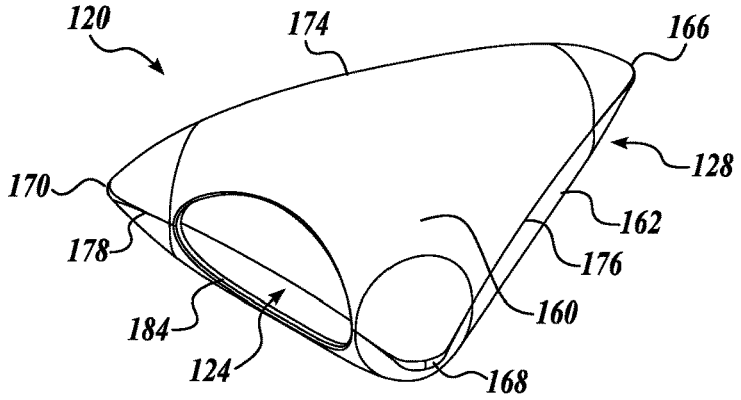
FIG. 4 is an isometric view of a cosmetic applicator formed in accordance with an alternative exemplary embodiment of the present disclosure.
Figure 5:
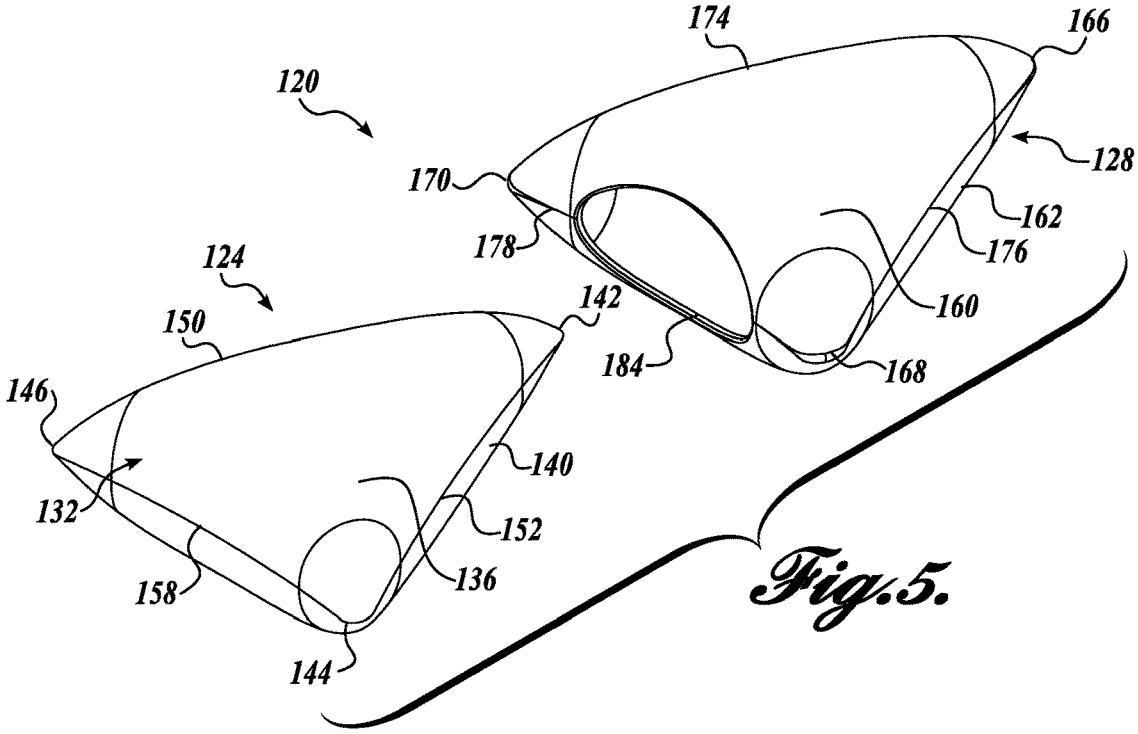
FIG. 5 is an exploded view of the cosmetic applicator of FIG. 4.
Figure 6:
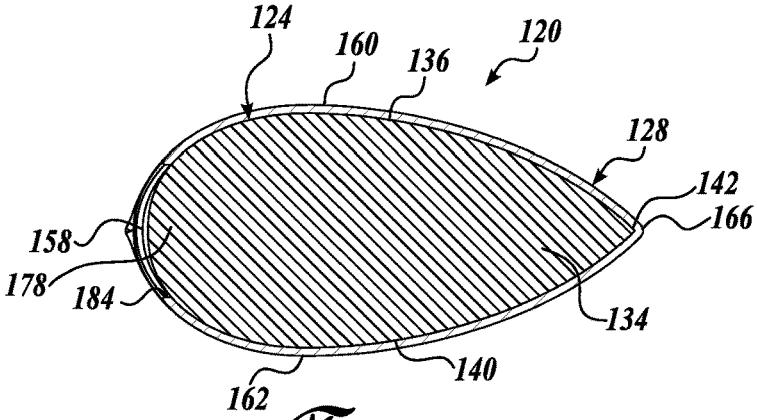
FIG. 6 is a cross-sectional view of the cosmetic applicator of FIG. 4.

Referring to FIGS. 4-6, a cosmetic applicator 120 formed in accordance with an alternative exemplary embodiment of the present disclosure is depicted. The cosmetic applicator 120 is substantially identical to the cosmetic applicator 20 described above except that the cosmetic applicator 120 is triangle-shaped rather than square or rectangular-shaped. For ease of reference, certain like parts are labeled with like reference numerals except in the '100 series. In that regard, the cosmetic applicator 120 includes an air-filled core 124 receivable within a cover 128. The core 124 has a body 132 that includes first and second opposing sides 136 and 140, first, second, and third corners 142, 144, and 146, first, second, and third sealed edges 150, 152, and 158, and an interior compartment 134. Similarly, the cover 128 includes first and second opposing sides 160 and 162, first, second, and third corners 166, 168, and 170, first, second, and third sealed edges 174, 176, and 178, and an opening 184. With the triangular shape (i.e., two sides and three corners), the cosmetic applicator 120 is optimized for precise, targeted areas, such as under the eyes.

Although the exemplary embodiments of the cosmetic applicators 20 and 120 are shown as square/rectangular-shaped or triangle-shaped with first and second opposing sides, the cosmetic applicators 20 and 120 may instead be any suitable shape or geometry. For instance, in alternative embodiments, the cosmetic applicator may be oval, cylindrical, or cone-shaped, or any other suitable regular or irregular shape. The shape may be depend on the cosmetic formula being application (i.e., different shapes may be used for foundation, lip gloss, eye shadow, nail polish, cleansers, etc.) and/or the area on which it is being applied (i.e., face, nails, lips, eyes, etc.)

Figure 7:
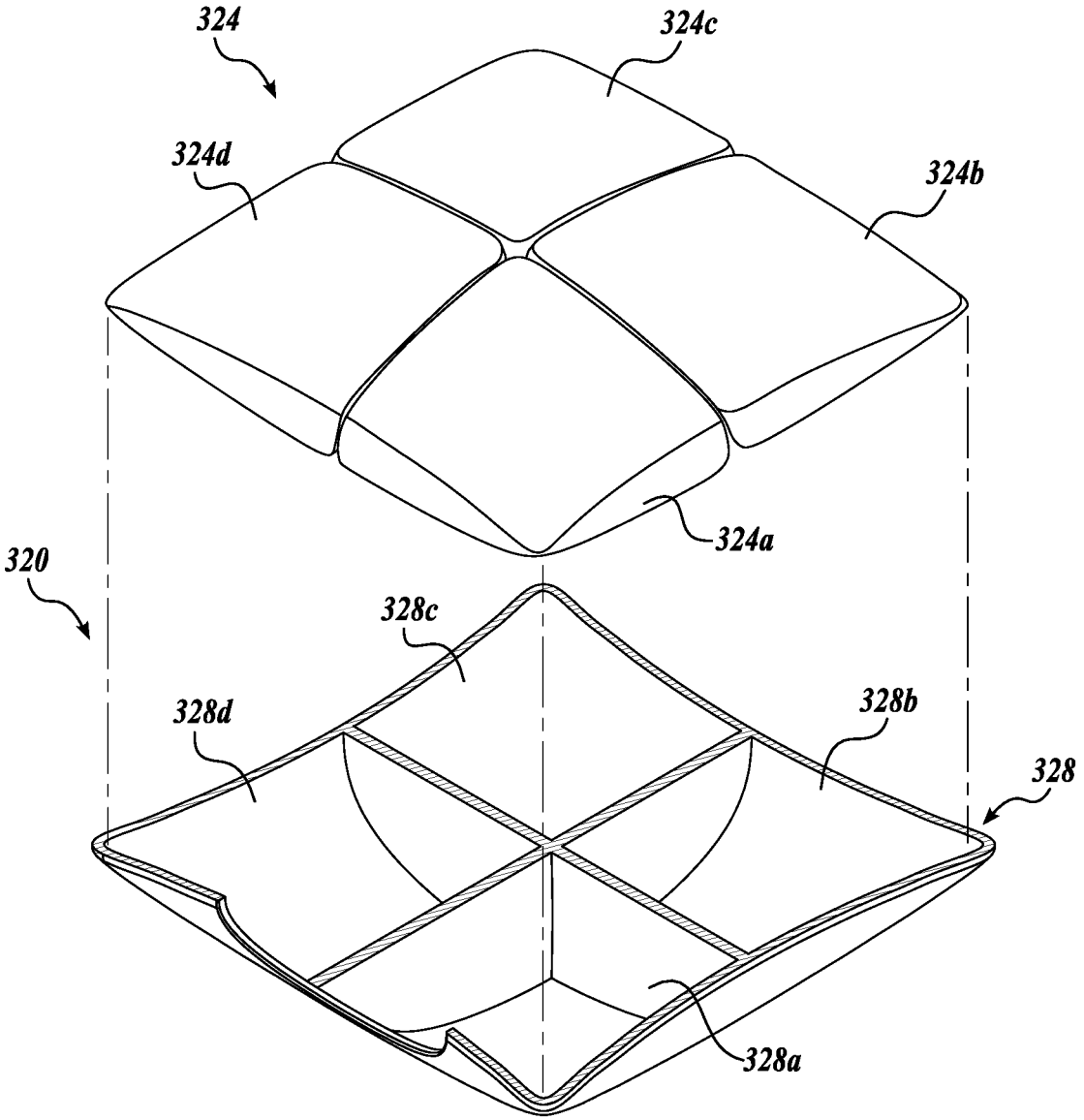
FIG. 7 is an isometric view of a cosmetic applicator formed in accordance with another alternative exemplary embodiment of the present disclosure.

Referring to FIG. 7, a cosmetic applicator 320 formed in accordance with another alternative exemplary embodiment of the present disclosure is depicted. The cosmetic applicator 320 is substantially identical to the cosmetic applicator 20 described above except that the cosmetic applicator 320 includes multiple pressurizeable cores 324*a*, 324*b*, 324*c*, and 324*d* that are receivable within a cover 328 having a corresponding number of sleeves or pockets 328*a*, 328*b*, 328*c*, and 328*d*. Each pocket 328*a*, 328*b*, 328*c*, and 328*d* may have an opening (not shown) such that the pressurizeable cores 324*a*, 324*b*, 324*c*, and 324*d* may be removably receivable therein. It can be appreciated that each core 324*a*, 324*b*, 324*c*, and 324*d* may be uniquely chosen (i.e., material, thickness, density, surface pattern, etc.), and/or uniquely pressurized, and/or uniquely filled (with a gas, liquid, foam, etc.) to create a cosmetic applicator 320 having different areas of firmness, density, malleability, sensorial effects, etc. In the alternative or in addition thereto, each pocket 328*a*, 328*b*, 328*c*, and 328*d* may be made from a unique material, and/or have a unique coating, and/or have a unique surface configuration, pattern, texture, etc., to create a single cosmetic applicator 320 having various applications or uses. It should be appreciated that the cosmetic applicator 320 may instead be triangle-shaped or any other suitable shape.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of a cosmetic applicator and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein. For instance, any feature or configuration described above with respect to the core may be adapted for use with the cover, and vice versa.

Although certain descriptive terms are used to illustrate or describe certain aspects or benefits of the present invention, they should not be seen as limiting. For instance, although the term "applicator" is used, it should be appreciated that the cosmetic applicators 20, 120, 220, and 320 may also be used for cleansing, removal of cosmetic formulation, treatment of skin conditions, or other uses.

The present disclosure also includes references to directions, such as "upper," "lower," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic formulation" or "cosmetic" (as used with the phrase "cosmetic applicator") should be interpreted broadly to include any cosmetic formulation, beauty product, lotion, lacquer, etc., generally applied to a person's skin, eyes, nails, or other body part. Moreover, it should be appreciated that the cosmetic applicator may also be adapted for other uses.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "substantially," "about," "approximately," etc., mean plus or minus 5% of the stated value.

While illustrative embodiments have been illustrated and described, it will be appreciated that various changes can be made therein without departing from the spirit and scope of the invention.

The invention claimed is:

1. A cosmetic applicator comprising: a core defined by a pressurizable body being made from a deformable material and having at least one interior compartment that is configured to be pressurized, the pressurizable body having at least first and second soft edges defined between the first and second opposing sides such that the pressurizable body has an overall pillow shape, wherein each of the first and second opposing sides are generally convex in shape and taper toward at least one corner; and a cover removably securable on the core, wherein the cover includes an elastic opening configured such that the core can be passed through the elastic opening and received within the cover.

2. The cosmetic applicator of claim 1, wherein the pressurizable body has at least first, second, and third corners.

3. The cosmetic applicator of claim 1, wherein the pressurizable body includes at least one opening configured to selectively allow at least one of a gas, liquid, and a fluid to flow into and out of the at least one interior compartment.

4. The cosmetic applicator of claim 1, wherein at least one of the core and the cover includes at least one textured surface.

5. The cosmetic applicator of claim 1, wherein at least one of the core and the cover includes at least a first area made from a first material and second area made from a second material.

6. The cosmetic applicator of claim 1, wherein at least one of the core and the cover is comprised at least in part of at least one of a hydrophilic material and a hydrophobic material.

7. The cosmetic applicator of claim 6, wherein the hydrophilic material is chosen from a group consisting of polyvinylpyrolidone (PVP), polyurethanes, polyacrylic acid (PAA), polyethylene oxide (PEO), polysaccharides, and any combination thereof.

8. The cosmetic applicator of claim 6, wherein the hydrophobic material is chosen from a group consisting of manganese oxide polystyrene (MnO2/PS) nano-composite, zinc oxide polystyrene (ZnO/PS) nano-composite, precipitated calcium carbonate[3], carbon nano-tube structures, silica nano-coating, and any combination thereof.

9. The cosmetic applicator of claim 6, wherein the at least one of the core and the cover is treated with a plasma treatment.

10. A cosmetic applicator comprising: a core defined by a pressurizable body being made from a deformable material and having at least one interior compartment that is configured to be pressurized, the pressurizable body having at least first and second soft edges defined between the first and second opposing sides such that the pressurizable body has an overall pillow shape, wherein each of the first and second opposing sides are generally convex in shape and taper toward at least one corner; and a cover securable on the core, wherein the cover includes an elastic opening configured such that the core can be passed through the elastic opening and received within the cover.

11. The cosmetic applicator of claim 10, wherein the pressurizable body has at least first, second, and third corners.

12. The cosmetic applicator of claim 10, wherein the pressurizable body includes at least one opening configured to selectively allow at least one of a gas, liquid, and a fluid to flow into and out of the at least one interior compartment.

13. The cosmetic applicator of claim 10, wherein at least one of the core and the cover is comprised at least in part of at least one of a hydrophilic material and a hydrophobic material.

14. The cosmetic applicator of claim 13, wherein the hydrophilic material is chosen from a group consisting of polyvinylpyrolidone (PVP), polyurethanes, polyacrylic acid (PAA), polyethylene oxide (PEO), polysaccharides, and any combination thereof.

15. The cosmetic applicator of claim 10, wherein at least one of the core and the cover includes at least one textured surface.

16. The cosmetic applicator of claim 10, wherein at least one of the core and the cover includes at least a first area made from a first material and second area made from a second material.

17. The cosmetic applicator of claim 10, wherein the cover includes at least one area of varying thickness.

* * * * *